US009315989B2

(12) United States Patent
Criaud

(10) Patent No.: US 9,315,989 B2
(45) Date of Patent: Apr. 19, 2016

(54) SYSTEM FOR ASSEMBLING WIND BRACING ON A GLAZED WALL

(75) Inventor: Annie Criaud, Saint-Cloud (FR)

(73) Assignee: AGC FRANCE SAS, Saint-Cloud (FR)

( * ) Notice: Subject to any disclaimer, the term of this patent is extended or adjusted under 35 U.S.C. 154(b) by 0 days.

(21) Appl. No.: 14/117,289

(22) PCT Filed: May 9, 2012

(86) PCT No.: PCT/EP2012/058491
§ 371 (c)(1),
(2), (4) Date: Nov. 12, 2013

(87) PCT Pub. No.: WO2012/156240
PCT Pub. Date: Nov. 22, 2012

(65) Prior Publication Data

US 2014/0311067 A1 Oct. 23, 2014

(30) Foreign Application Priority Data

May 13, 2011 (FR) ..... 11 01451

(51) Int. Cl.
*E04B 2/96* (2006.01)
*E04B 2/74* (2006.01)
*E06B 3/54* (2006.01)

(52) U.S. Cl.
CPC ..... *E04B 2/965* (2013.01); *E04B 2/7455* (2013.01); *E04B 2/96* (2013.01); *E04B 2/967* (2013.01); *E06B 3/5454* (2013.01)

(58) Field of Classification Search
CPC ..... E04B 2/96; E04B 2/92; E04B 2/925; E04B 2/967; E04B 2/965; E04B 2/7455; E04B 2/88; E04B 2/885; E04B 2/90; E06B 3/5454
USPC ..... 52/282.1, 282.2, 282.4, 282.5, 208, 52/235, 238.1, 283, 266
See application file for complete search history.

(56) References Cited

U.S. PATENT DOCUMENTS 4,115,964 A * 9/1978 Montrouil ..... 52/106
4,134,238 A * 1/1979 Auger ..... 52/127.3
4,691,489 A * 9/1987 Shea, Jr. ..... 522/35
(Continued)

FOREIGN PATENT DOCUMENTS

EP 0 534 143 3/1993
FR 144307 6/1965
(Continued)

OTHER PUBLICATIONS

International Search Report Issued Jul. 26, 2012 in PCT/EP12/058491 Filed May 9, 2012.

*Primary Examiner* — Robert Canfield
*Assistant Examiner* — Babajide Demuren
(74) *Attorney, Agent, or Firm* — Oblon, McClelland, Maier & Neustadt, L.L.P.

(57) ABSTRACT

A wind bracing for a wall including an assembled collection of infill panels mounted on a bearing structure, the wind bracing including a glass panel and a mounting mechanism securing the glass panel to the wall. The mounting mechanism includes at least one mounting section piece with a shape that delimits a housing into which the glass panel is engaged and in which the housing is fixed by adhesive bonding. The mounting mechanism also includes adapting and fixing members for fixing the mounting section piece to an upright or to a cross member of the bearing structure.

25 Claims, 4 Drawing Sheets

(56) References Cited

U.S. PATENT DOCUMENTS

| | | | | |
|---|---|---|---|---|
| 5,546,713 | A * | 8/1996 | Voegele et al. | 52/202 |
| 5,622,017 | A * | 4/1997 | Lynn et al. | 52/209 |
| 5,853,828 | A * | 12/1998 | Schimmelpenningh et al. | 428/34 |
| 6,581,342 | B1 * | 6/2003 | Tavivian | 52/204.595 |
| 2002/0100234 | A1 * | 8/2002 | Sprague | 52/208 |
| 2002/0124499 | A1 * | 9/2002 | Braybrook | 52/235 |
| 2003/0159376 | A1 * | 8/2003 | Huynh | 52/208 |
| 2006/0000146 | A1 | 1/2006 | Heads et al. | |

FOREIGN PATENT DOCUMENTS

| | | |
|---|---|---|
| FR | 1 447 307 | 11/1966 |
| JP | 2002-317519 | 10/2002 |
| JP | 2004-124648 | 2/2004 |
| JP | 2004-063405 | 4/2004 |
| JP | 2010-043456 | 2/2010 |

* cited by examiner

SYSTEM FOR ASSEMBLING WIND BRACING ON A GLAZED WALL

TECHNICAL FIELD

The present invention relates to the general technical field of the creation of facades or walls made of glass, for example for buildings. The present invention relates notably to the construction and/or renovation of lightweight facades or glasswork.

When a building facade is made of glass, use is generally made of an assembly of glazing panels. The glazing panels generally have a length and a width of several meters. These dimensions are obviously dependent on the particular application.

In order to create a glazed building facade it is necessary to join together several glazing panels. Such an assembly entails the use of a bearing structure comprising cross members and uprights. The bearing structure moreover comprises frame elements which provide a building with strength, of the slab or wall type in concrete, steel or wood. By way of example, lightweight facades and glasswork are fixed to these frame elements.

The cross members and uprights are therefore used to secure the glazing panels for example to a metal structure of the building. These cross members and these uprights also provide the facade with thermal insulation, acoustic insulation, air tightness, water tightness and wind tightness.

These cross members and these uprights also have the function of mechanically stabilizing the facade with respect to climatic loadings and with respect to its own weight.

These cross members and these uprights may also contribute to safety with respect to impacts and/or blasts generated by explosions.

The present invention relates more particularly to the creation of lightweight facades, known as curtain facades or curtain walls, and to the creation of wind bracing for said facades. These lightweight facades are borne by the structure, referred to as the primary framework, of a building made in metal, concrete or wood.

The term wind bracing needs to be understood in the broad sense so that it includes elements of the truss type, used for example in roofing.

The present invention can also be applied in various constructions such as glasswork or glass roofs for example.

PRIOR ART

Bearing structures in which the uprights and cross members are integrally formed with section pieces made of aluminum, steel, wood or comprising a combination of different materials, are known.

Known curtain wall systems comprising cross members and uprights made in aluminum, wood or steel, often, notably in the case of the uprights, have the disadvantage of being highly visible from outside and inside the glazed facade.

In order to increase the transparency of the glasswork or of the lightweight facades, referred to as curtain walls or curtain facades, it has been proposed that some of the uprights and/or cross members be replaced by a strip of glass, referred to as wind bracing and situated on the inside of the building.

Thus, for simple facade glazing such a strip of glass may, in the place of an upright, constitute a continuous support for the glazing. This then entails glass-to-glass bonding using products referred to as "structural". These products, for example structural mastics, are generally made of silicone or based on silicone. Structural mastics differ from sealants which are intended only to provide sealing, in that they react and/or transfer load to the structure. Such a technique cannot, however, be applied to insulating, double or triple glazing because the lack of normative standards relating to such a technique means that compulsory insurance plan cover cannot be obtained. As a result, such a technique cannot be exploited.

Moreover, it is considered that the sealing of an insulating glazing needs to be able to "breath", i.e. to allow ventilation, whereas the use of silicone mastic between two glazings would prevent any ventilation.

Furthermore, this technique is difficult to master on building sites, notably to ensure sealing and the mechanical integrity of the assembly. It may also be noted that it is difficult to achieve on a building site the cleanness and other conditions needed for achieving a good structural bond.

Assemblies in which the uprights are replaced by smaller sized connecting pieces arranged at regular intervals and vertically along a zone in which insulating glazing panels are bonded together edge to edge are also known. These pieces constitute the mechanical connection firstly between the insulating glazing panels and secondly to the glass wind bracing. For that purpose, the wind bracing has holes for fixing said connecting pieces. The wind bracing therefore has to be made of toughened glass because drilling a hole reduces the mechanical strength of the glass and it is actually around the hole that the stresses will be applied in service. Heat strengthening the glass makes it possible to obtain the level of strength of the glass that is compatible with the loads passing via the holes.

The connecting pieces designed specifically for each application do, however, remain visible from the outside of the building and from the inside. Further, the sealing of the assembly is not guaranteed because it relies exclusively on the skill of the company performing this assembly technique. It should also be noted that certain regulations do not authorize the edge-to-edge bonding of insulating glazing unless special measures are taken. Such measures are mentioned, for the case of France, in the reference document DTU39 P1-1.

By way of example, mention may be made of a connecting piece in the shape of an H section, in which the edges of two glazing panels are engaged to face one another. The connecting piece also comprises, on its side situated on the inside of the building, a U-shaped section piece into which the glass wind bracing is engaged. The glass wind bracing is fixed to the connecting piece by a screw that passes through said wind bracing and said connecting piece. A sealing mastic is used to seal between the edge-to-edge glazing panels, away from the connecting pieces.

Structural glass facade systems with fittings are also known, and in such systems the wind bracing is connected to the facade by special purpose metal components and holes made in the facade. These systems are extremely expensive because the wind bracing and the structural glass have to be made of toughened glass and are complicated to design and to produce. These are elements that are said to be structural which can bear their own weight and the climatic and exploitation loadings. The design rules on calculating the thicknesses are different than those covering elements referred to as "infill" elements because of the margins of safety taken into consideration. The glass is thicker and therefore more expensive. Each build also requires its own specific design notably for the connecting pieces that connect with the structure of the building. The underlying assumptions may vary (suspended or fixed bracing, provisions for articulating the girders, etc.) according to the foreseeable deformation of the building under load and as a result of expansion. The manufacture for example of slender structural elements requires special skill on the part of the customizing party (toughening, laminating, handling) and the fitting of these systems requires special skills of the companies, which is an obstacle to their being used by conventional companies. These systems are therefore not compatible with commonplace glazing and with commonplace facade frameworks.

With the aforementioned assembly systems it is found that the air tightness, water tightness or wind tightness is neither optimized nor mastered. Further, it is not possible to limit thermal bridging. Regulatory requirements cannot therefore be met. The performance of these systems is therefore very much dependent on the knowhow and skill of the company engaged to create the facade.

For roofing applications it has been found that no aforementioned system is reliable in that any infiltrating water is not collected and drained away.

DISCLOSURE OF THE INVENTION

It is an object of the present invention to overcome the aforementioned disadvantages by proposing new glass wind bracing for a facade or wall which impairs neither the sealing nor the esthetic appearance nor the mechanical stability of said facade or wall.

Another object of the present invention is to overcome the disadvantages associated with the known assembly systems by proposing a new system for assembling glass wind bracing with glazed facades, that impairs neither the sealing nor the esthetic appearance of the facades.

Another object of the present invention is to propose a new system for assembling and fixing glass wind bracing which is economical and easy to implement.

Another object of the present invention is to provide glass wind bracing that can be produced simply and economically in the form of preassembled subassemblies.

The stated objects of the invention are achieved using wind bracing for a wall comprising an assembled collection of infill panels mounted on a bearing structure, said wind bracing comprising a glass panel and mounting means for securing said glass panel to the wall, characterized in that the mounting means comprise at least one mounting section piece the shape of which delimits a housing into which the glass panel is engaged and in which it is fixed by adhesive bonding, the mounting means also comprising adapting and fixing members for fixing said mounting section piece to an upright or to a cross member of the bearing structure.

According to one embodiment of wind bracing according to the invention, the housing in cross section has a U-shape with one lateral branch extending on one side of the glass panel and another lateral branch extending on the other side of the glass panel, the bottom of the U-shape facing an end edge face of said glass sheet.

According to one embodiment of the wind bracing according to the invention, the mounting means comprises sealing means arranged in the housing between the glass panel and the lateral branches.

According to one embodiment of the wind bracing according to the invention, the mounting means comprise positioning shims arranged in the housing between the glass panel and the lateral branches.

According to one embodiment of the wind bracing according to the invention, the adapting and fixing members form an adapting section piece secured to the mounting section piece and in cross section having a complementary U-shape, the complementary lateral branches of which extend away from the housing, the separation of said complementary lateral branches being adapted to the dimensions of the upright or of the cross member of the bearing structure.

According to one embodiment of the wind bracing according to the invention, the adapting and fixing members comprise a bearing face of the mounting section piece which face is intended to come into contact with an upright or a cross member of the bearing structure, and lateral arms intended firstly to be articulated removably with their end on the mounting section piece and secondly to be fixed to the corresponding upright or cross member when said lateral arms are collaborating mechanically with said mounting section piece to make a rigid mechanical connection.

By way of example, the wind bracing according to the invention comprises several mounting means distributed along an edge face of the glass panel.

Advantageously, the mounting section piece is provided with holes and/or grooves for the injection of a glue and/or a sealant.

Alternatively or in addition, the adapting and fixing members are provided with holes for injecting an adhesive and/or a sealant. Alternatively or in addition, the adapting section piece is provided with holes and/or grooves for the injection of a glue and/or a sealant.

The stated objectives of the invention are also achieved using a system for assembling wind bracing as outlined hereinabove and an assembled collection of infill panels, of which the bearing structure comprises uprights and cross members, characterized in that the adapting and fixing members are mechanically connected to an upright or to a cross member by way of a bonding means in the form of a coat of adhesive, a double-sided sticky tape and/or screws.

According to one embodiment of the assembling system according to the invention, the infill panels are made of insulating glass, of the double glazing or triple glazing type.

According to one embodiment of the assembling system according to the invention, the glass panel is made of a single sheet of glass or of an insulating glass of the double glazing or triple glazing type.

According to one embodiment of the assembling system according to the invention, the bearing structure is a secondary framework of a building.

The stated objectives of the invention are also achieved using a curtain wall or a curtain facade, glasswork or a roof comprising wind bracing or, in the case of a roof, trusses, as outlined hereinabove.

The wind bracing and assembling system both in accordance with the invention have the advantage of reducing the dimensions of the opaque part or parts at the interface between said wind bracing and a facade. The invention makes it possible for example to reduce the opaque parts down to approximately 40 or 50 mm in length for a strip of glass 350 mm thick. The strip of glass in fact reacts the self weight loadings and the weather loadings caused by wind or depression to which the facade is subjected, making it possible to reduce the dimensions of the section pieces that form the uprights and/or the cross members of the bearing structure.

Such wind bracing in accordance with the invention therefore provides the assembly with mechanical stability and may also contribute to safety with respect to impacts.

Moreover, with the wind bracing and assembling systems in accordance with the invention, the conventional section pieces still perform their functions of connection to the insulating glazing of the facade or of the roof and their function of air tightness, water tightness and wind tightness. The same is true of the drainage and collection of water ingress of insulating glazing rebates.

These section pieces intrinsically, as in the past, meet the acoustic and thermal regulatory requirements for glazed assemblies.

One advantage of the wind bracing and of the assembling system both in accordance with the invention lies in therefore in the maintained performance and properties of a commercially available facade or glasswork system.

Another advantage of the invention lies in the possibility of using annealed glazing, laminated or otherwise, with no holes made in it, for creating the wind bracing without there being a need for said glazing to be toughened beforehand. This glazing is also more widely available. This then yields a not-insignificant economic advantage.

Another advantage of the wind bracing according to the invention is obtained through the possibility of adapting it to all section pieces of commercially available bearing structures, this being achieved simply by a change in size.

Another advantage of the invention lies in the fact that the facade glazing and the wind bracing is installed in the conventional way and does not require the fitting company to have specialist skills.

BRIEF DESCRIPTION OF THE DRAWINGS

Other features of the present invention will become more clearly apparent from reading the following description, made with reference to the attached drawing given by way of nonlimiting illustrative example, in which.

EMBODIMENT(S) OF THE INVENTION

Elements that are structurally and functionally identical and present in several different figures are assigned the same numerical or alphanumerical reference.

Figure 1:
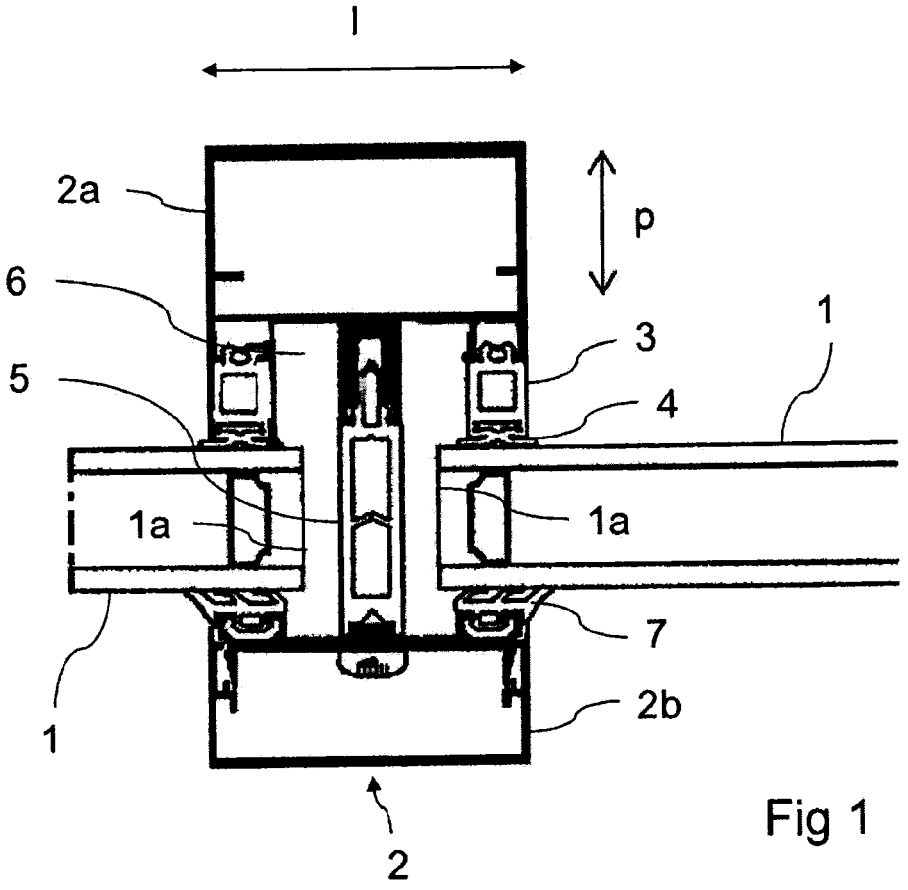
FIG. 1 is a partial view in horizontal section of one embodiment of a facade intended to collaborate mechanically with wind bracing according to the invention.

FIG. 1 is a partial view in horizontal section of a facade or wall intended to collaborate mechanically with glass wind bracing. The wall comprises an assembled collection of infill panels 1 mounted on a bearing structure. The latter, which is known per se, is made up of uprights 2 and cross members.

The uprights 2 constitute means of mounting the infill panels 1 and of joining them together.

Each upright 2 has, facing the infill panels 1, a structural interior part 2*a* and an exterior part 2*b* mounted on said interior part 2*a* for fixing and mechanically connecting two adjacent infill panels 1.

The interior part 2*a* also comprises positioning members 3 associated with sealing means 4 against which the infill panels 1 bear.

The exterior part 2*b* comprises a tightly fitting cover strip, a trim and a fixing member 5, of the screw or bolt type, to provide mechanical attachment to the interior part 2*a*. The fixing member 5 advantageously passes through the wall in a space 6 located around the edges 1*a* of two adjacent infill panels 1.

The exterior part 2*b* clamps the infill panels 1 by resting against the external faces of said infill panels 1. This resting is achieved advantageously via additional sealing means 7.

The sealing means 4 and the additional sealing means 7 are preferably in the form of seals. These are made for example of a material of the EPDM or silicone type or from some other elastomeric material.

The interior part 2*a* is a section piece, for example made of metal, having a width I of between 45 and 80 mm and a depth p of between 25 and 300 mm. By way of example, such a section piece, intended for a curtain wall, has a width I of 50 mm and a depth p of around 25 mm.

By way of alternative, the interior part 2*a* and/or the exterior part 2*b* may be made of wood or of PVC. It is also conceivable for the interior part 2*a* to be made of a metallic material, for example aluminum, and for the exterior part 2*b* to be made of a different material. This is particularly advantageous in terms of the trim of the exterior part 2*b*.

Figure 2:
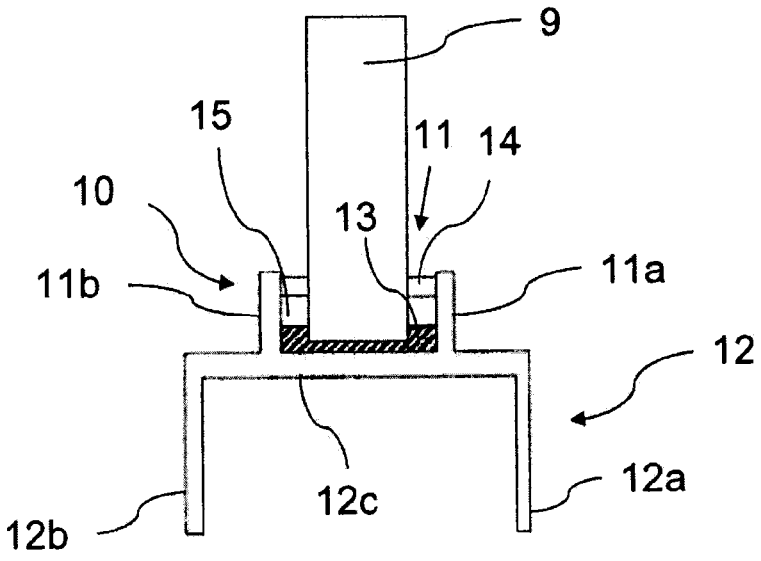
FIG. 2 is a schematic view in cross section of one embodiment of wind bracing according to the invention for constituting part of an assembling system according to the invention.

FIG. 2 is a partial schematic view in cross section of one embodiment of wind bracing according to the invention. The wind bracing according to the invention is intended for example to be fixed to a wall comprising an assembled collection of infill panels 1 which are mounted on a bearing structure.

The wind bracing comprises a glass panel 9 and mounting means for securing said glass panel 9 to the wall.

The mounting means comprise at least one mounting section piece 10 the shape of which delimits a housing 11 into which the glass panel 9 is engaged and fixed by adhesive bonding.

The mounting means also comprise adapting and fixing members for fixing said mounting section piece 10 to the upright 2 or alternatively to a cross member of the bearing structure.

The adapting and fixing members for this purpose comprise an adapting section piece 12 intended to fit over the interior part 2*a*.

The housing 11 in cross section has the shape of a U with one lateral branch 11*a* extending on one side of the glass panel 9 and the other lateral branch 11*b* extending on the other side of the glass panel 9. The bottom of the U-shape is situated facing an end edge face 9*a* of said glass panel 9. A coat of structural mastic 13 is advantageously applied to the bottom of the housing 11.

According to one embodiment of the wind bracing according to the invention, the mounting means comprise a sealing and/or finishing means arranged in the housing 11, between the glass panel 9 and the lateral branches 11*a* and 11*b*. The sealing means advantageously consists of at least one coat of sealing mastic 14 or of a section piece made of EPDM or of silicone.

According to one embodiment of the wind bracing according to the invention, the mounting means comprise positioning shims 15 arranged in the housing 11 between the glass panel 9 and the lateral branches 11*a* and 11*b*. The positioning shims 15 allow the glass panel 9 to be centered in the housing 11 and are positioned between the coat of structural mastic 13 and the coat of sealing mastic 14.

The adapting section piece 12 secured to the mounting section piece 10 has in cross section a complementary U-shape the complementary lateral branches 12*a* and 12*b* of which extend away from the housing 11 and away from the lateral branches 11*a* and 11*b*. The separation of the complementary lateral branches 12*a* and 12*b* is adapted to suit the width I of the upright 2. The part 12*c* of section piece that connects the complementary lateral branches 12*a* and 12*b* advantageously constitutes the bottom of the U-shape and the bottom of the complementary U-shape.

The part 12*c* of section piece may be fixed by adhesive bonding to the interior part 2*a* by any means, including double-sided sticky tape or mastic. Such an operation needs to be performed on site by the company.

According to one embodiment, the mounting section piece 10 and the adapting section piece 12 are made as a single element, for example in aluminum.

According to another embodiment, the mounting section piece 10 and the adapting section piece 12 are made in several parts and assembled by adhesive bonding and/or by screwing or clipping.

Figures 3A, 3B, 3C:
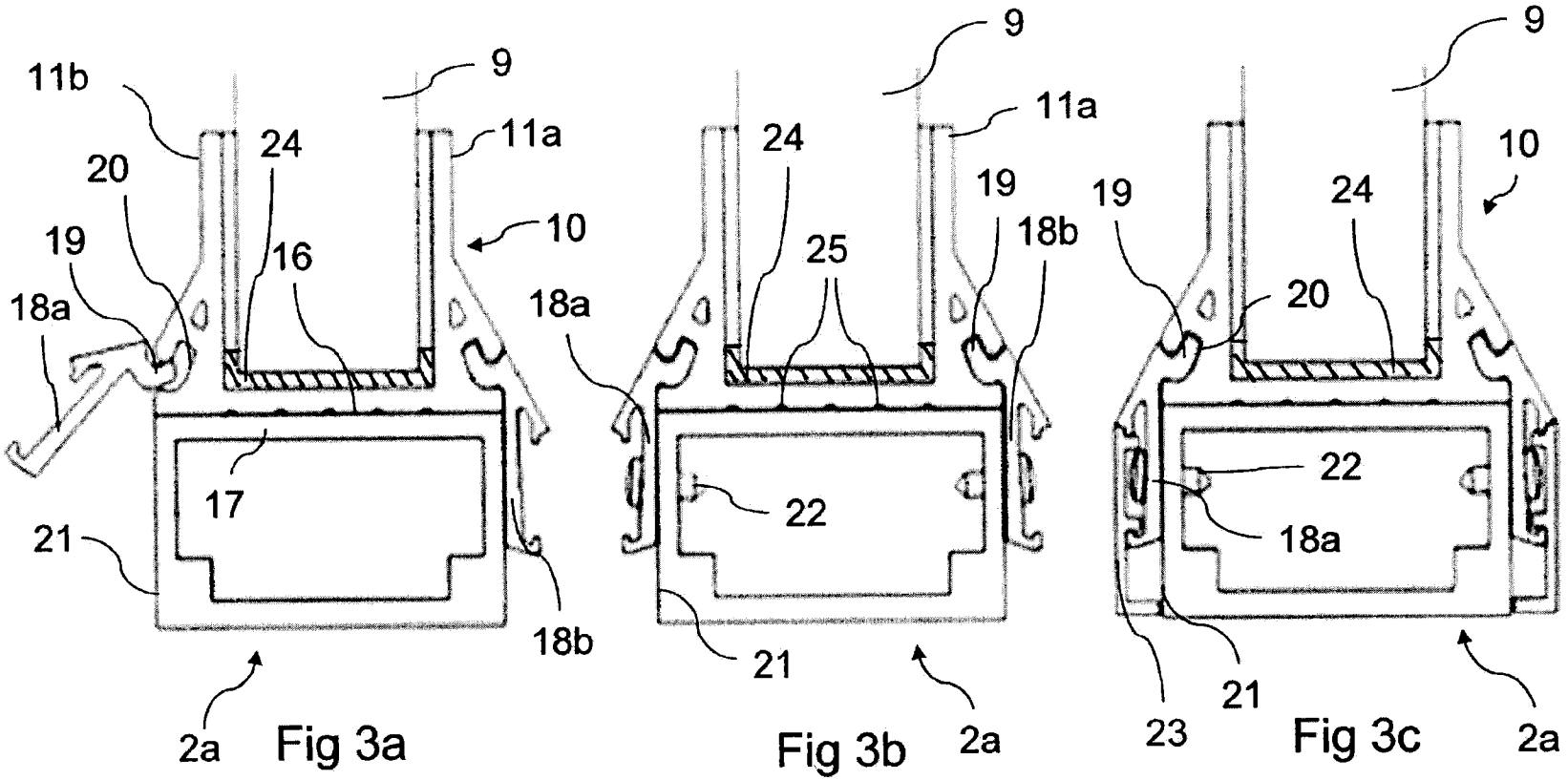
FIGS. 3*a*, 3*b* and 3*c* illustrate the operations of fixing another embodiment of wind bracing according to the invention to an upright of a glazed facade to form the assembling system according to the invention.

FIGS. 3*a*, 3*b* and 3*c* schematically illustrate the operations of fixing another embodiment of wind bracing according to the invention, made in several parts, to an upright 2.

In this embodiment, the adapting and fixing members comprise a bearing face 16 of the mounting section piece 10. The bearing face 16 is in contact with one end 17 of the interior part 2*a* of the upright 2. The adapting and fixing members also comprise lateral arms 18*a* and 18*b* which are intended firstly to be articulated removably with their hook-shaped end 19 to the mounting section piece 10. Cutouts 20 of a shape that more or less complements the ends 19 are provided on the mounting section pieces 10 so as to allow for engagement and an articulated relative movement of said lateral arms 18*a* and 18*b*.

These articulations thus allow the lateral arms 18*a* and 18*b* to be positioned on respective lateral faces 21 of the interior part 2*a*.

The lateral arms 18*a* and 18*b* are then fixed to the lateral faces 21 while at the same time still mechanically collaborating with said mounting section piece 10 in order to establish a rigid mechanical connection between the interior part 2*a* and said mounting section piece 10. This fixing is obtained for example using screws 22, supplemented if necessary by adhesive bonding.

Protective covers 23 are then advantageously clipped on to the lateral arms 18*a* and 18*b*. These protective covers 23 protect the screws 22 on the one hand and improves the esthetic appearance of the wind bracing according to the invention.

The glass panel 9, consisting of a strip of simple, monolithic or laminated glass, is secured to the mounting section piece 10 using a coat of adhesive 24.

Figure 4:
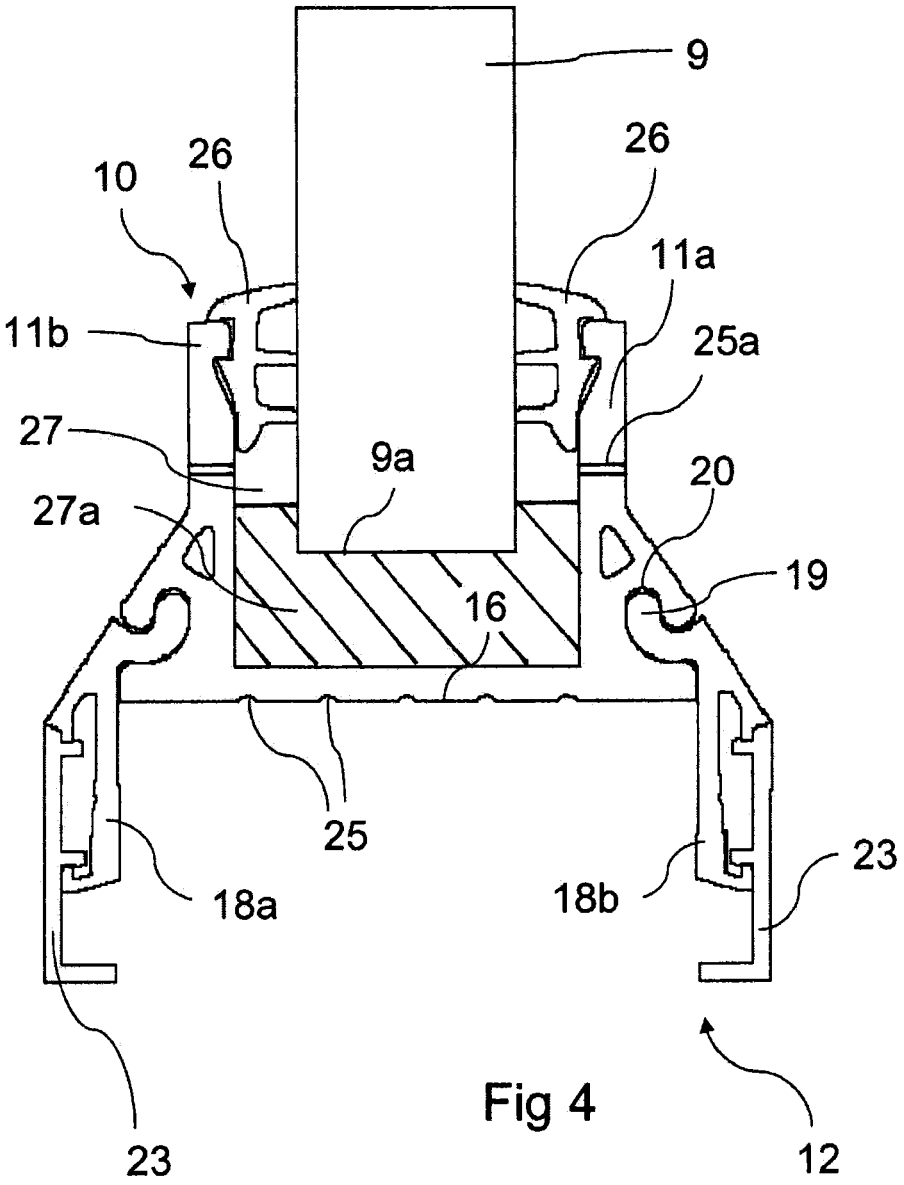
FIG. 4 is a view in cross section of another embodiment of wind bracing according to the invention to constitute part of an assembling system according to the invention, and FIGS. 5 and 6 schematically illustrate wind bracing according to the invention mounted on a facade, viewed respectively from the inside and from the outside.

In the embodiment illustrated in FIG. 4, the bearing face 16 has grooves 25 intended to be filled with an adhesive, so as to improve the mechanical bond to the interior part 2*a*. The screws 22 used for fixing the lateral arms 18*a* and 18*b* to the interior part 2*a* have not been depicted.

The mounting section piece 10 and the adapting section piece 12 may also have perforations 25*a* or holes for the injection of adhesive or any other adhesive or sealing material.

In this embodiment, the glass panel 9 comprises, on each of its faces, a seal 26 made of EPDM or of silicone. This seal may be secured to the glass panel 9 by bonding. The silicone seal 26 advantageously has a shape that makes it clippable on to an interior face of a lateral arm 18*a* or 18*b* that has a shape suited to that. Mounting the glass panel 9 on the mounting section piece 10 creates an empty space 27 on the inside of the mounting section piece 10. This space is at least partially filled with a structural adhesive 27*a*.

The shapes of the components intended for clip fastening in the context of the invention are known per se and therefore not described further.

Figure 5:
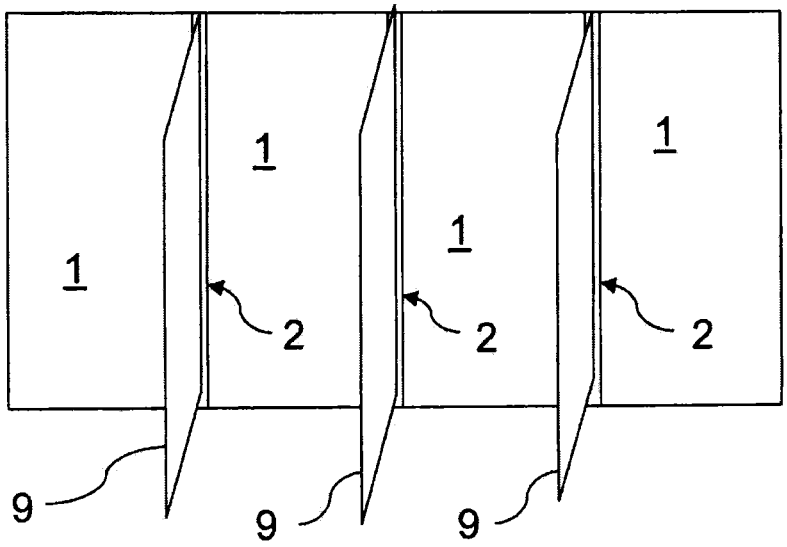
Figure 6:
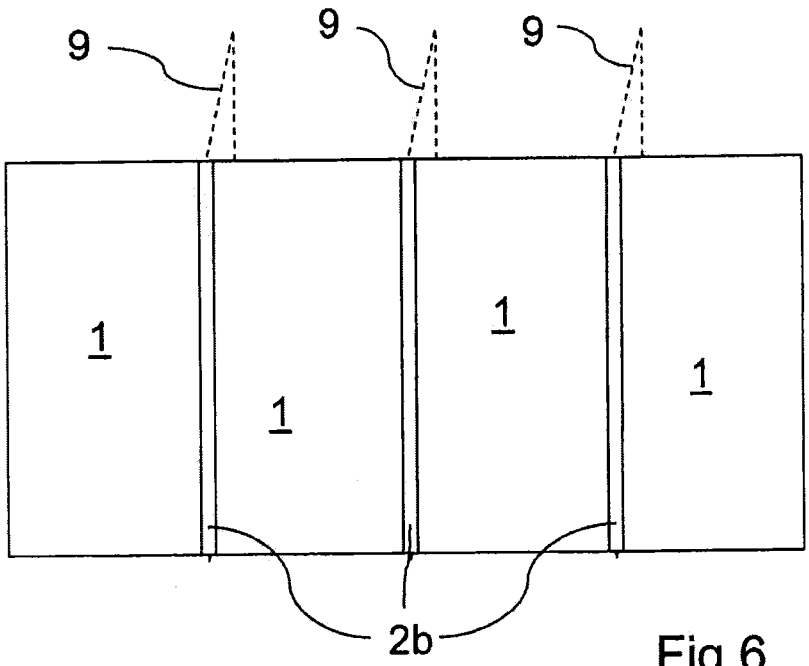

FIGS. 5 and 6 schematically illustrate wind bracing according to the invention mounted on a lightweight facade. FIG. 5 is a view from the inside of the facade comprising an assembled collection of infill panels 1. FIG. 6 is a view of this same facade from the outside.

It is quite obvious that the present description is not restricted to the examples explicitly described but also comprises other embodiments and/or implementations. Thus, a technical feature described or an implementation step described can be replaced by an equivalent technical feature or by an equivalent step respectively without departing from the scope of the present invention.

The invention claimed is:

1. A building comprising:

a bearing structure having at least one upright and/or at least one cross member;

a curtain wall including an assembled collection of infill panels mounted on the bearing structure; and a wind bracing comprising:

a glass panel configured to be mounted perpendicular to the curtain wall on an inside of the building; and a mounting means for securing the glass panel to the curtain wall;

wherein the mounting means comprises at least one mounting section piece with a shape that delimits a housing into which the glass panel is engaged and in which the glass panel is fixed by adhesive bonding, the mounting means further comprising adapting and fixing members for fixing the mounting section piece to the upright or to the cross member of the bearing structure.

2. The building according to claim 1, wherein the housing in cross section has a U-shape with one lateral branch extending on a first side of the glass panel and another lateral branch extending on a second side of the glass panel, a bottom of the U-shape facing an end edge face of the glass panel.

3. The building according to claim 2, wherein the mounting means comprises sealing means arranged in the housing between the glass panel and the lateral branches.

4. The building according to claim 2, wherein the mounting means comprises positioning shims arranged in the housing between the glass panel and the lateral branches.

5. The building according to claim 1, wherein the adapting and fixing members form an adapting section piece secured to the mounting section piece and in cross section having a U-shape with complementary lateral branches, the complementary lateral branches of which extend away from the housing, separation of the complementary lateral branches configured to dimensions of the upright or of the cross member of the bearing structure.

6. The building according to claim 1, wherein the adapting and fixing members comprise a bearing face of the mounting section piece which contacts the upright or the cross member of the bearing structure, and lateral arms configured to be articulated removably with their end on the mounting section piece and fixed to the corresponding upright or cross member when the lateral arms are collaborating mechanically with the mounting section piece to make a rigid mechanical connection.

7. The building according to claim 1, wherein the mounting section piece includes holes and/or grooves for injection of a glue and/or a sealant.

8. The building according to claim 1, wherein the adapting section piece includes holes and/or grooves for injection of a glue and/or a sealant.

9. A system for assembling the building of claim 1, wherein the adapting and fixing members are mechanically connected to the upright or to the cross member by a bonding means in a form of a coat of adhesive, a double-sided sticky tape, and/or screws.

10. The assembling system according to claim 9, wherein the bearing structure is a secondary framework of the building.

11. A wind bracing comprising:

a glass panel mounted on an inside of a building and perpendicular to a curtain wall the curtain wall including an assembled collection of infill panels, and the curtain wall mounted on a bearing structure;

at least one mounting section piece with a shape that delimits a housing into which the glass panel is engaged and in which the glass panel is fixed by adhesive bonding; and adapting and fixing members for fixing the mounting section piece to an upright or to a cross member of the bearing structure of the building.

12. The wind bracing according to claim 11, wherein the housing in cross section has a U-shape with one lateral branch extending on a first side of the glass panel and another lateral branch extending on a second side of the glass panel, a bottom of the U-shape facing an end edge face of the glass panel.

13. The wind bracing according to claim 12, further comprising sealing means arranged in the housing between the glass panel and the lateral branches.

14. The wind bracing according to claim 12, further comprising positioning shims arranged in the housing between the glass panel and the lateral branches.

15. The wind bracing according to claim 11, wherein the adapting and fixing members form an adapting section piece secured to the mounting section piece and in cross section having a U-shape with complementary lateral branches, the complementary lateral branches of which extend away from the housing, separation of the complementary lateral branches configured to dimensions of the upright or of the cross member of the bearing structure.

16. The wind bracing according to claim 11, wherein the adapting and fixing members comprise a bearing face of the mounting section piece which is configured to come into contact with the upright or the cross member of the bearing structure, and lateral arms configured to be articulated removably with their end on the mounting section piece and to be fixed to the corresponding upright or cross member when the lateral arms are collaborating mechanically with the mounting section piece to make a rigid mechanical connection.

17. The wind bracing according to claim 11, wherein the mounting section piece includes holes and/or grooves for injection of a glue and/or a sealant.

18. The wind bracing according to claim 11, wherein the adapting section piece includes holes and/or grooves for injection of a glue and/or a sealant.

19. A wind bracing comprising:

a glass panel to be mounted on an inside of a building and adjacent to a curtain wall, the curtain wall including an assembled collection of infill panels, the curtain wall mounted on a bearing structure;

at least one first mounting section piece with a shape that delimits a housing into which the glass panel is engaged and in which the glass panel is fixed by adhesive bonding; and an adapting section piece with a shape that delimits a housing into which an inside portion of an upright or a cross member of the bearing structure of the building will engage so that the glass panel engages the curtain wall perpendicularly.

20. The wind bracing of claim 19, wherein the wind bracing is mounted between, and perpendicular to, two infill panels.

21. The wind bracing of claim 20, where the infill panels are glass panels.

22. The wind bracing of claim 19, wherein the building structure is a roof.

23. The wind bracing of claim 19, wherein the building structure is a glasswork.

24. The wind bracing of claim 11, wherein the wind bracing is mounted between, and perpendicular to, two infill panels.

25. The wind bracing of claim 24, where the infill panels are glass panels.

* * * * *